US008176664B2

(12) United States Patent
Delmotte et al.

(10) Patent No.: US 8,176,664 B2
(45) Date of Patent: May 15, 2012

(54) TEXTILE COMPLEX, COMMUNICATING PANEL AND METHOD OF DISPLAYING THE TEXTILE COMPLEX

(75) Inventors: Jean-Philippe Delmotte, Marcy l'Etoile (FR); Eric Bihr, Meys (FR)

(73) Assignee: Prismaflex International (FR)

( * ) Notice: Subject to any disclaimer, the term of this patent is extended or adjusted under 35 U.S.C. 154(b) by 0 days.

(21) Appl. No.: 12/964,349

(22) Filed: Dec. 9, 2010

(65) Prior Publication Data

US 2011/0078935 A1 Apr. 7, 2011

Related U.S. Application Data

(63) Continuation of application No. PCT/FR2009/051089, filed on Jun. 10, 2009.

(30) Foreign Application Priority Data

Nov. 6, 2008 (FR) ..... 08 03248

(51) Int. Cl.
*G09F 17/00* (2006.01)

(52) U.S. Cl. ..... 40/603; 160/368.1

(58) Field of Classification Search ..... 40/603; 160/368.1
See application file for complete search history.

(56) References Cited

U.S. PATENT DOCUMENTS

| | | | | |
|---|---|---|---|---|
| 324,164 | A * | 8/1885 | Raisbeck | 40/124.11 |
| 1,184,124 | A * | 5/1916 | Pfiffner | 40/620 |
| 2,775,048 | A * | 12/1956 | Berman | 40/595 |
| 3,601,917 | A * | 8/1971 | Shankman | 40/622 |
| 6,904,709 | B2 * | 6/2005 | Craig et al. | 40/590 |
| 2004/0163293 | A1 | 8/2004 | Hughes | |

FOREIGN PATENT DOCUMENTS

| | | | |
|---|---|---|---|
| EP | 1376517 | A1 | 1/2004 |
| FR | 2823357 | A1 | 10/2002 |
| GB | 970648 | A | 9/1964 |

OTHER PUBLICATIONS

International Search Report; PCT/FR2009/051089; Dec. 2, 2009; 3 pages.

* cited by examiner

*Primary Examiner* — Joanne Silbermann
(74) *Attorney, Agent, or Firm* — St. Onge Steward Johnston & Reens LLC

(57) ABSTRACT

A textile complex adapted to be attached to a communicating panel includes a textile sheet having, on at least one face, loops adapted to engage with a self-gripping strip provided with hooks; a coating film attached to a face of the textile sheet; and a printing ink deposited on the coating film. The textile complex has a capacity for preferential elastic deformation in a direction of deployment on the communicating panel. A communicating panel and to a corresponding method of display are also provided.

19 Claims, 4 Drawing Sheets

TEXTILE COMPLEX, COMMUNICATING PANEL AND METHOD OF DISPLAYING THE TEXTILE COMPLEX

CROSS-REFERENCE TO RELATED APPLICATIONS

The present application is a continuation of pending International patent application PCT/FR2009/051089 filed on Jun. 10, 2009 which designates the United States and claims priority from French patent application 0803248 filed on Jun. 11, 2008, the content of which is incorporated herein by reference.

FIELD OF THE INVENTION

The invention relates to the field of the display for advertising purposes of a textile complex on a display panel support.

The invention is more specifically related to display panel supports for receiving display bills that have loops on at least one of their faces in order to form a loop and hook assembly with the support.

BACKGROUND OF THE INVENTION

In a general way, this type of display bill is implemented with a paper support whereon a textile sheet such as knitted fabric is bonded. Such a display device and the corresponding display bills thereof have been described in particular in the document EP-1 376 517.

However, this type of display bill has great rigidity and is not suitable for the display of large-size advertisements. Indeed, with this type of device, it is not possible to pre-stress the display bill when placing it on the support and, consequently, it is inevitable that many unsightly creases are generated on the surface of the advertisement.

The document GB 970 648 describes for its part a display bill that has, on a rear face, loops to allow it to be secured to a display panel fitted with self-gripping strips provided with hooks.

Such a display bill may certainly be flexible, but under no circumstances is it elastic. It is therefore impossible with this type of display bill to position it on a display support without generating creases on its surface.

The purpose of the invention is thus to provide a display bill, a communicating panel and a display method with the display bill being reversibly secured to the panel by means of loops and hooks which allow a large-scale display bill to be put into position without generating any creases on its surface.

Another inventive objective is to allow said display bill to be easily transported without it becoming crumpled.

Lastly, a further purpose of the invention is to restrict the number of operations involved in making up a display bill of this type to a straightforward cut in the format of the corresponding panel.

SUMMARY OF THE INVENTION

The invention therefore relates to a textile complex intended to be attached to a communicating panel. According to the invention, the textile complex is characterised in that it comprises:

- a textile sheet having, on at least one face, loops intended to engage with a self-gripping strip provided with hooks;

- a coating film attached to a face of the textile sheet;
- a printing ink deposited on the coating film, The textile complex has for its part a capacity for preferential elastic deformation in a direction of deployment on the communicating panel.

In other words, the textile complex has on the whole of its rear face evenly distributed loops, said loops being formed directly by the textile sheet. Furthermore, the elasticity of the textile complex allows it to be positioned on the panel while avoiding the formation of creases on its surface. Indeed, the textile complex may be tensile pre-stressed when it is positioned on the panel.

Moreover, the textile sheet has great flexibility and crease-resistance features to facilitate the transportation thereof and the positioning thereof on the display support. A textile sheet of this kind can be made using a non-woven or knitted fabric in particular. This textile sheet may in particular be made out of a polyolefin material such as polyethylene or polypropylene, or polyester, and having a mass per unit area of 70 g/m$^2$ for example.

The coating film may be extruded and then calendered on the textile or calendered directly. The coating film may thus be made of a polyolefin material such as polyethylene or polypropylene, charged with an additive preferably of the polyolefin family conferring elastic properties thereupon as well as good printability, or again a charged polyurethane.

The coating film may also be surface treated, using for example a "Corona" treatment, to improve ink resistance.

To advantage, the direction of deployment of the textile complex may match the weft of the textile sheet.

In other words, the textile complex has a capacity for preferential elastic deformation in the direction of shortest length of the display bill corresponding to the width of a roll of the textile complex.

In practice, the textile complex may have tensile yield strength in the direction of deployment of more than 7.5%.

In this way, it is possible to pre-stress the textile complex on the support sufficiently for the creases on its surface to be eliminated once it is deployed on the communicating panel.

According to one particular embodiment, the ratio between the yield strength in the direction of deployment and the yield strength in a perpendicular direction may be greater than or equal to 2.

The textile complex is thus twice as elastic in its direction of deployment for which tensioning means can be used to exert a tensile stress on the textile complex.

The invention also relates to a communicating panel which is characterised in that it comprises:

- a textile complex as previously described attached to a support that has at least two lateral self-gripping strips and a third self-gripping strip arranged perpendicularly relative to the at least two lateral self-gripping strips and being positioned in proximity to one of the ends thereof, the three self-gripping strips each being provided with hooks engaging with the loops arranged on two lateral selvedges and on a third selvedge of the textile sheet;
- a section moving in translatory motion capable of deploying the textile complex, said section being fitted with a self-gripping strip provided with hooks engaging with the loops arranged on a deployment selvedge of the textile sheet parallel to the third selvedge.

In other words, the communicating panel comprises a section moving in translatory motion that allows the textile complex to be deployed on a support. This deployment is implemented by causing a deployment selvedge of the textile sheet to engage with a self-gripping strip provided with hooks attached to the section moving in translatory motion.

The section moving in translatory motion can be moved in a vertical or horizontal direction according to the particular geometry and use of the communicating panel.

To advantage, the panel may have a second section arranged in parallel relative to the moving deployment section, said second section being fitted with a self-gripping strip provided with hooks engaging with the loops arranged on the third selvedge of the textile sheet. In practice, the second section may be capable of translatory motion.

In other words, for some uses, it is possible to position the moving sections so that they are offset relative to the communicating panel in order to make it easier for a display bill to be put in position. In particular, it is possible to position two horizontal moving sections underneath a display panel to allow an operator to place the display on a communicating panel without having to use a ladder or any particular device to place the display bill on the display support.

According to one advantageous embodiment, the panel may have at least one central self-gripping strip provided with hooks arranged on the support between two self-gripping strips engaging with the loops arranged on the selvedges of the textile sheet.

In this way, the central self-gripping strip provides an additional bonding zone between the display panel and the textile complex. Said central strip is particularly useful when there is significant stress on the panel from the external environment and, in particular, when the panel is subject to the action of the wind.

A central strip of this kind may be arranged in various orientations and in particular it may be oriented so that it is parallel with the lateral self-gripping strips of the panel, i.e. perpendicularly relative to the direction of deployment of the textile complex. It may also be oriented so that it is parallel relative to the third selvedge and the deployment selvedge of the textile complex, i.e. perpendicularly relative to the direction of deployment of the display bill, for some specific uses.

According to a particular embodiment, the panel may have means for inhibiting the lateral and/or central self-gripping strips provided with hooks and arranged on the support.

It is thus possible to render the lateral and/or central self-gripping strips provided with hooks inactive when positioning the display bill on the display support. Such an arrangement is advantageous since the display bill can then be slid directly in contact with the display support when putting it into position.

To advantage, the inhibition means comprise a cover intended to cover the hooks of the self-gripping strip and guides provided in parallel on either side of the self-gripping strip to make a sliding joint between the cover and the support.

In other words, a cover is used to cover the self-gripping strip over its entire length when putting the display bill into position. This cover is positioned on the self-gripping strip and then slid in guides secured to the support that implement a joint for sliding the cover relative to the support.

According to one advantageous embodiment, the two guides may be attached to the support by bonding.

Consequently, the guides are secured to the support via a straightforward and inexpensive method.

The invention also relates to a method of displaying a textile complex on a communicating panel as described previously. According to the invention the display method is characterised in that it involves the steps comprising:

causing the loops arranged on the deployment selvedge of the textile sheet to engage with the self-gripping strip provided with hooks and arranged on the section moving in translatory motion;

causing the moving section to move in translatory motion into a position of deployment of the textile complex;

causing the loops arranged on the third selvedge of the textile sheet to engage with the self-gripping strip provided with hooks and arranged on the support;

applying a tensile stress to the moving section in order to stretch the textile complex in its direction of deployment;

removing at least one cover arranged opposite at least one self-gripping strip provided with hooks and arranged on the support, the cover being previously positioned on the support opposite the at least one self-gripping strip provided with hooks;

applying a compression stress to the textile complex to cause the loops of the textile sheet to engage with the at least one self-gripping strip provided with hooks and arranged on the support.

In this way, the display bill is both put into position on the support and tensioned in the direction of deployment of the display bill by means of the moving section.

According to one particular embodiment, the loops arranged on the deployment selvedge and the third selvedge of the textile sheet can be made to engage with the self-gripping strips provided with hooks and arranged on the panel by starting with the centre of the textile sheet and applying a tensile stress in the direction of the lateral selvedges.

Thus, by acting in this way, the display bill is also tensioned on the support in a direction transverse to the direction of deployment of the display bill.

To advantage, the covers may be put into position using a spatula.

Indeed, a spatula may allow an operator to pull the covers at their upper end in a specific direction, when they are no longer accessible by the operator.

In practice, the compression stress applied to the textile complex may be transmitted by means of the spatula.

In this way, the spatula also allows the textile complex to be flattened onto the display support. To do this, the spatula has a plane surface intended not to damage the textile complex.

According to one advantageous embodiment, the covers can be removed one after the other starting from the centre of the textile complex towards the lateral selvedges.

In other words, once the textile complex is positioned on the support, the covers are removed one after the other and by applying the tensile stress to the textile complex between each cover removal.

BRIEF DESCRIPTION OF THE DRAWINGS

The implementation of the invention and the resulting advantages will become clearer from the following embodiment, supported by the appended figures, wherein.

DETAILED DESCRIPTION OF THE INVENTION

As already mentioned, the invention relates to a textile complex and a display panel fitted with such a complex.

Figure 1:
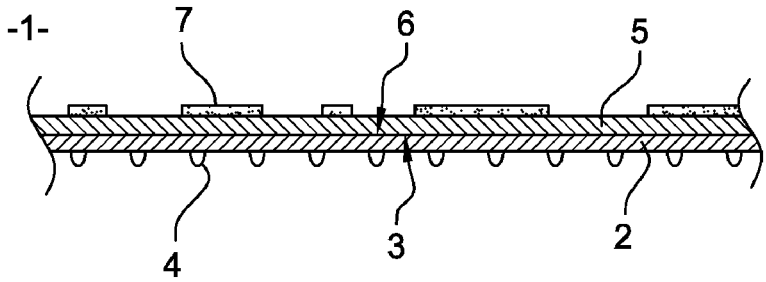
FIG. 1 is a cross-section view of a textile complex according to the invention.

As shown in FIG. 1, the textile complex 1 comprises a textile sheet 2 that has on its lower face 3 loops 4. These loops are intended to cause this textile complex to engage with a display support on which self-gripping strips provided with hooks are placed.

Said textile complex also comprises on an opposite face 6 a coating film 5 attached to the textile sheet 2.

A printing ink 7 is then deposited on the coating film 5. The coating ink is used to communicate an advertising message, particularly on the surface of the textile complex. It thus corresponds to the visible face of the textile complex.

Figure 2:
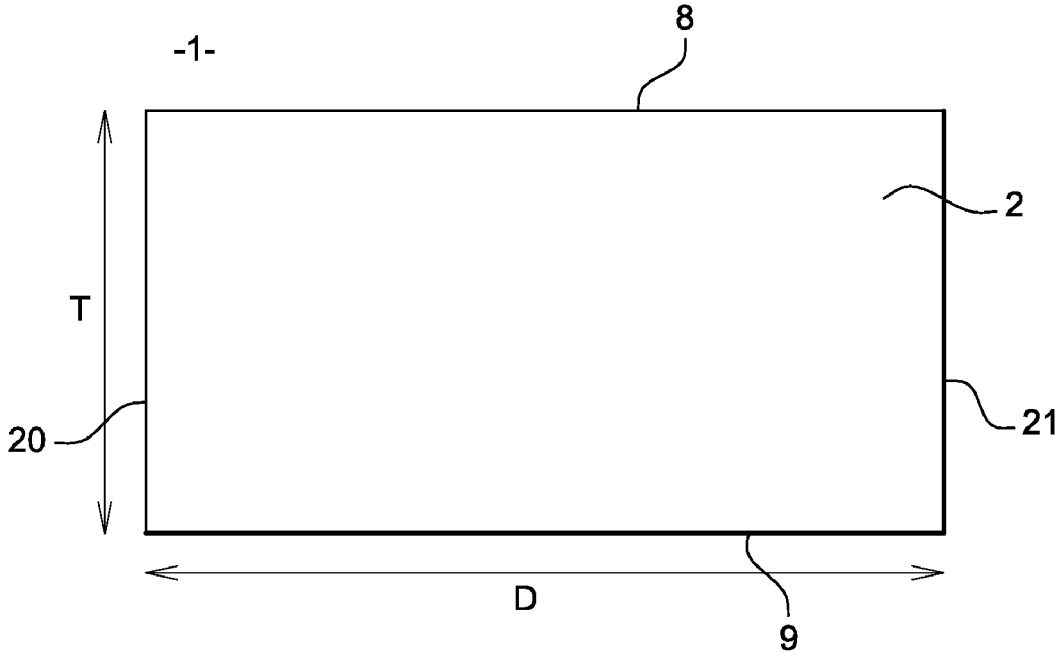
FIG. 2 is a front view of the textile complex according to the invention.

As shown in FIG. 2, the textile complex 1 is arranged on a communicating panel in a direction of deployment D. Said textile complex has a capacity for elastic deformation that is greater in this direction of deployment D relative to the transverse direction T. Furthermore, the selvedges of the textile sheet consist of a deployment selvedge 21, two lateral selvedges 8, 9 and a third selvedge 20 parallel to the deployment selvedge 21.

Figure 3:
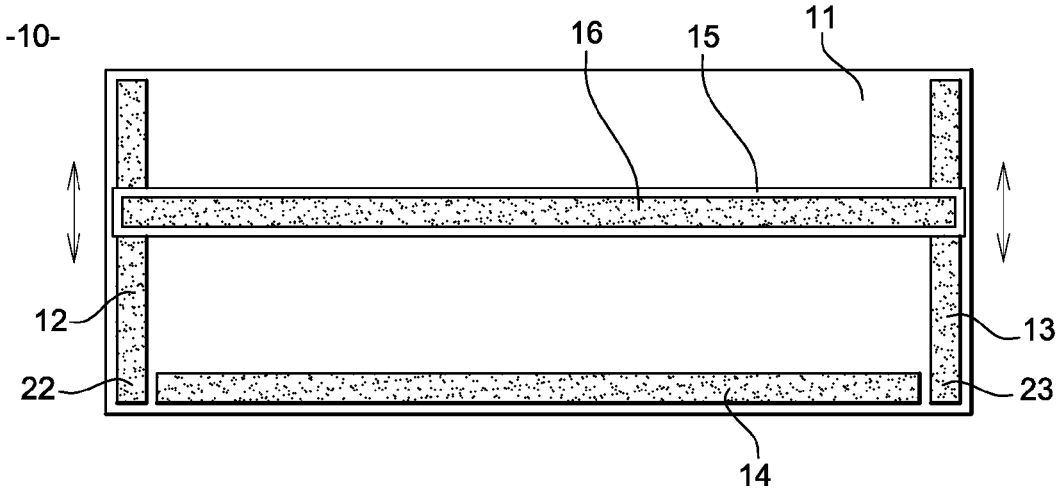
FIGS. 3 to 7 are diagrammatic representations of different communicating panels according to the invention.

As shown in FIG. 3, a communicating panel 10 comprises a display support 11 on which are placed two lateral self-gripping strips 12, 13 and a third self-gripping strip 14 positioned between the two lateral strips 12, 13 at the ends thereof 22, 23.

The communicating panel 10 also comprises a section 15 moving in translatory motion relative to the support 11. This moving section 15 supports a self-gripping strip 16 provided with hooks capable of engaging with the deployment selvedge 21 of the textile complex.

In this embodiment, the deployment is implemented vertically upwards. Consequently, initially the deployment selvedge 21 is put into position on the self-gripping strip 16. The section 15 is positioned in a high position, the third selvedge 20 of the textile complex is secured to the third self-gripping strip 14. A tensile stress is applied in the direction of deployment of the textile complex by means of the moving section 15 in order to eliminate creases.

Inhibition means are removed from the lateral self-gripping strips 12, 13 and then a compression stress is applied to the textile complex in order to make the lateral selvedges 8, 9 of the textile complex engage with the lateral self-gripping strips 12, 13.

Figure 4:
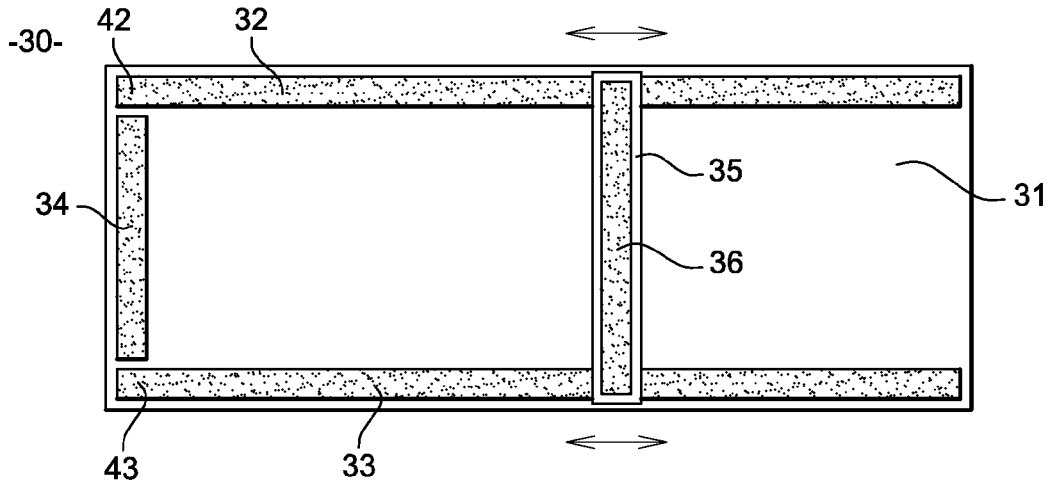

As shown in FIG. 4, the communicating panel 30 may also have a horizontal direction of deployment. In this case, the deployment selvedge 21 is positioned in contact with a self-gripping strip 36 arranged vertically on a moving section 35. The moving section 35 is positioned in a deployment position located laterally to the right and the third selvedge 20 is made to engage with the third self-gripping strip 34.

A tensile stress is applied in a horizontal direction to the textile sheet, the inhibition means are removed from the lateral self-gripping strips 32, 33 and the lateral selvedges 8, 9 are made to engage therewith.

Said horizontal deployment of a display bill on a display support may be of particular advantage for some uses such as advertising panels placed over a traffic lane, such as on a motorway.

Figure 5:
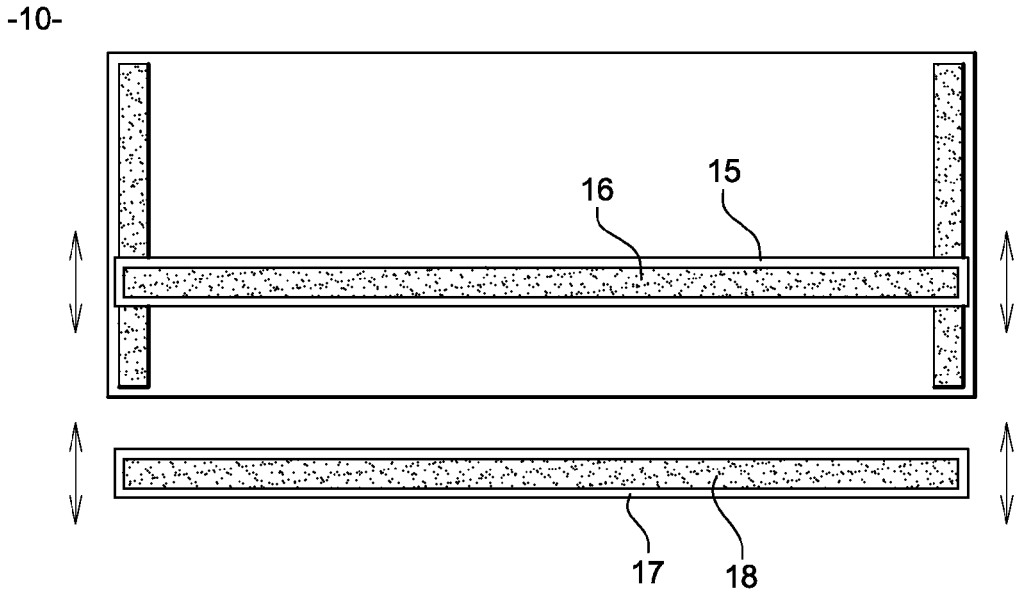

As shown in FIG. 5, the communicating panel 10 may also comprise a second moving section 17 on which the third self-gripping strip 18 is arranged.

Such an arrangement makes it easier for an operator to put a display bill into position when the panel is placed in a high position not manually accessible to the operator.

Figure 6:
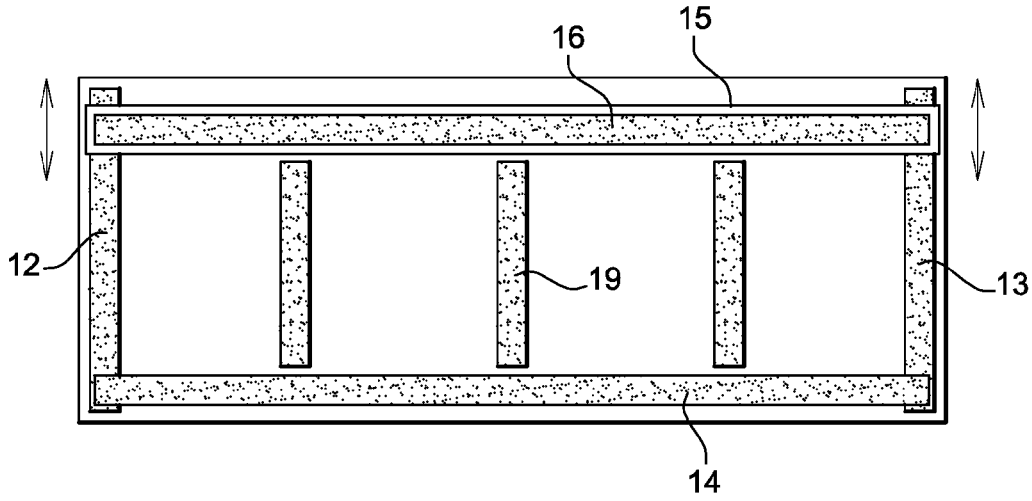

As shown in FIG. 6, the communicating panel may also comprise central self-gripping strips 19 arranged between the two lateral self-gripping strips 12, 13 in order to increase the bonding strength of the textile device on the display support.

In the same way as for the lateral strips 12, 13 inhibition means may be used to allow the textile complex to slide on the surface of the display support during its deployment.

Figure 7:
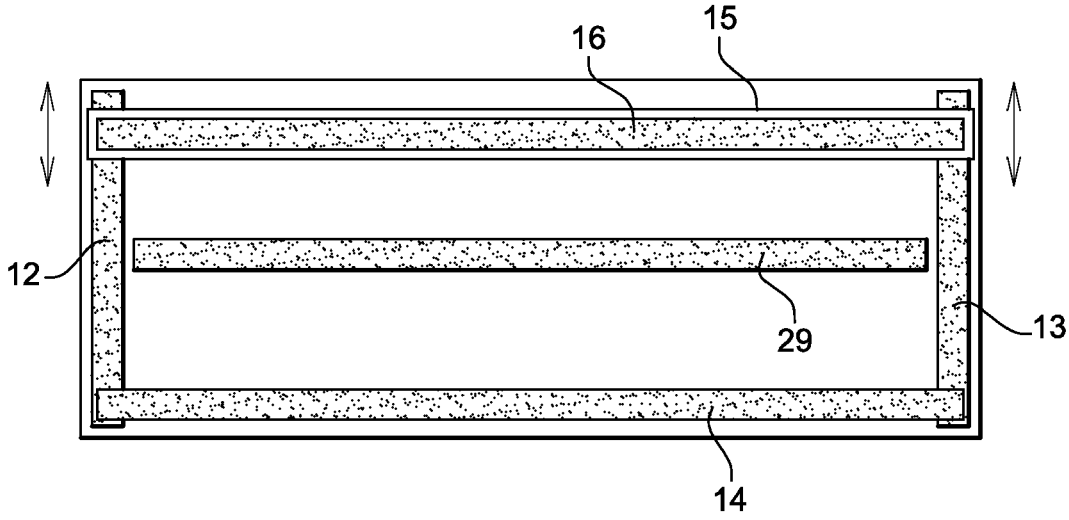

As shown in FIG. 7, the central self-gripping strip may also be positioned transversely relative to the self-gripping strips 12, 13. According to other alternatives, not shown, the central self-gripping strip may be positioned in any orientation between these two extreme positions that are parallel orientation relative to the direction of deployment as shown in FIG. 6 and a perpendicular orientation as shown in FIG. 7.

Figure 8:
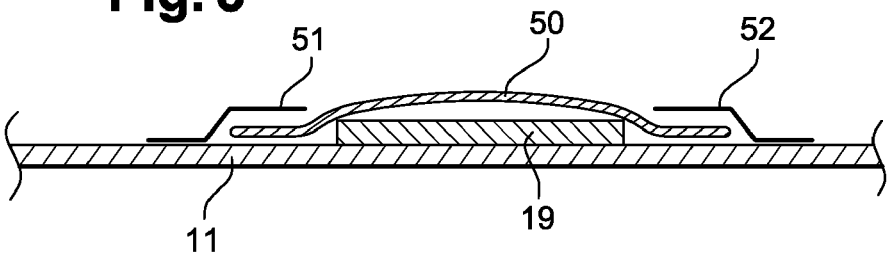
FIG. 8 is a cross-section view showing the inhibition means according to the invention.

As shown in FIG. 8, the inhibition means comprise a cover 50 for covering a self-gripping strip 19. They also comprise guides 51, 52 for making the sliding joint between the cover 50 and the display support 11. According to another embodiment, the inhibition means may be implemented by a remotely activated guillotine system, concealing or releasing the surfaces of the self-gripping strips.

Figure 9:
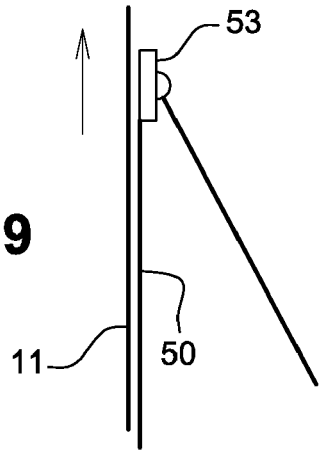
FIG. 9 is a side view of the spatula for putting the inhibition means into position.

As shown in FIG. 9, the cover 50 may be put into position on the display support 11 by means of a spatula 53 comprising means capable of drawing the cover inside the two guides.

It is clear from what has been said above that a complex, a display panel, and a display method according to the invention, have numerous advantages and in particular:

- the complex is sufficiently elastic to allow it to be positioned without creasing on a display panel support;
- the textile complex has crease-resistance features, which allows it to be transported and packed folded;
- this complex may be used both on backlit display panels and display panels lit via the front face;
- it can be easily cut out with the aid of any cutting tool, such as a pair of scissors or a Stanley knife in particular;
- it requires no making up after printing, except for an approximate dimensioning;
- no particular skill is required to lay this textile complex on the textile display support;
- it may be fireproofed, and particularly in accordance with the M1 class depending on the materials used;
- it means that large 3 to 5 m widths can be used and therefore the number of joins can be reduced when laying over large surfaces, and most sizes used in a single piece can be handled;
- it affords significant bonding strength capable of holding the textile complex on the display support;
- it allows very fast display removal by peeling the textile complex under the action of the force of gravity in particular.

What is claimed is:

1. A textile complex adapted to be attached to a communicating panel, said textile complex comprising:

a textile sheet having, on at least one face, loops formed directly by said textile sheet itself and covering substantially the entirety of the at least one face, said loops adapted to engage with a self-gripping strip provided with hooks; and a coating film attached on one face of the textile sheet;

a printing ink deposited on the coating film, wherein said textile complex is elastically deformable and has a capacity for greater elastic deformation in a direction of deployment on the communicating panel as compared to a direction perpendicular to the direction of deployment.

2. The textile complex as claimed in claim 1, wherein the direction of deployment of the textile complex matches a weft of the textile sheet.

3. The textile complex as claimed in claim 1, wherein said textile complex has a tensile yield strength in the direction of deployment greater than 7.5%.

4. The textile complex as claimed in claim 3, wherein a ratio between the tensile yield strength in the direction of deployment and a tensile yield strength in a direction perpendicular to the direction of deployment is greater than or equal to 2.

5. A communicating panel comprising:

the textile complex as claimed in claim 1 attached to a support comprising at least two lateral self-gripping strips and a third self-gripping strip arranged perpendicularly relative to said at least two lateral self-gripping strips and being positioned in proximity to one of the ends of at least two lateral self-gripping strips, said at least two lateral self-gripping strips and said third self-gripping strip each being provided with hooks engaging with loops arranged on two lateral selvedges and a third selvedge of the textile sheet; and a section moveable in translatory motion capable of deploying the textile complex, said section being fitted with a self-gripping strip provided with hooks engaging with loops arranged on a deployment selvedge of the textile sheet parallel to the third selvedge.

6. The communicating panel as claimed in claim 5, further comprising a second section arranged in parallel relative to the moveable deployment section, said second section being fitted with a self-gripping strip provided with hooks engaging with the loops arranged on the third selvedge of the textile sheet.

7. The communicating panel as claimed in claim 6, wherein said second section is moveable in translatory motion.

8. The communicating panel as claimed in claim 5, further comprising at least one central self-gripping strip provided with hooks and arranged on the support between two self-gripping strips engaging with the loops arranged on the selvedges of the textile sheet.

9. The communicating panel as claimed in claim 8, further comprising means for inhibiting the central self-gripping strips provided with hooks and arranged on the support.

10. The communicating panel as claimed in claim 9, wherein the inhibition means comprise a cover adapted to cover the hooks of the central self-gripping strips and two guides arranged in parallel on either side of the central self-gripping strips to make a sliding joint between the cover and the support.

11. The communicating panel as claimed in claim 10, wherein the two guides are attached to the support by bonding.

12. The communicating panel as claimed in claim 5, further comprising means for inhibiting the lateral self-gripping strips provided with hooks and arranged on the support.

13. The communicating panel as claimed in claim 12, wherein the inhibition means comprise a cover adapted to cover the hooks of the lateral self-gripping strips and two guides arranged in parallel on either side of the lateral self-gripping strips to make a sliding joint between the cover and the support.

14. The communication panel as claimed in claim 13, wherein the two guides are attached to the support by bonding.

15. A method of displaying the textile complex on the communicating panel of claim 5, said method comprising the steps of:

causing the loops arranged on the deployment selvedge of the textile sheet to engage with the self-gripping strip provided with hooks and arranged on the section moveable in translatory motion;

causing the moveable section to move in translatory motion into a position of deployment of the textile complex;

causing the loops arranged on the third selvedge of the textile sheet to engage with the third self-gripping strip provided with hooks and arranged on the support;

applying a tensile stress to the moveable section in order to stretch the textile complex in the direction of deployment;

removing at least one cover arranged opposite at least one lateral self-gripping strip provided with hooks and arranged on the support, said cover being previously positioned on the support opposite at least one lateral self-gripping strip provided with hooks; and applying a compression stress to the textile complex to cause the loops of the textile sheet to engage with the at least one lateral self-gripping strip provided with hooks and arranged on the support.

16. The method as claimed in claim 15, wherein the loops arranged on the deployment selvedge and the third selvedge of the textile sheet are made to engage with the self-gripping strips provided with hooks and arranged on the panel starting with a centre of the textile sheet and applying a tensile stress in a direction of the lateral selvedges.

17. The method as claimed in claim 15, wherein the covers are put into position using a spatula.

18. The method as claimed in claim 17, wherein the compression stress applied to the textile complex is transmitted by means of the spatula.

19. The method as claimed in claim 15, wherein the covers are removed one after the other starting with a centre of the textile complex towards the lateral selvedges.

* * * * *